United States Patent [19]

Yerman et al.

[11] Patent Number: 5,017,902

[45] Date of Patent: May 21, 1991

[54] CONDUCTIVE FILM MAGNETIC COMPONENTS

[75] Inventors: Alexander J. Yerman, Scotia, N.Y.; Khai D. T. Ngo, Gainesville, Fla.

[73] Assignee: General Electric Company, Schenectady, N.Y.

[21] Appl. No.: 359,063

[22] Filed: May 30, 1989

[51] Int. Cl.[5] ..... H01F 27/30

[52] U.S. Cl. ..... 336/83; 336/183; 336/200; 336/226; 336/232

[58] Field of Search ..... 336/200, 206, 223, 232, 336/183, 180, 226, 225, 182, 83

[56] References Cited

U.S. PATENT DOCUMENTS

| | | | |
|---|---|---|---|
| 2,851,765 | 9/1958 | Hanlet | 336/206 X |
| 2,921,165 | 1/1960 | Clarke | 336/226 X |
| 2,943,966 | 7/1960 | Leno et al. | 336/200 |
| 3,002,260 | 10/1961 | Shortt et al. | 336/200 X |
| 3,495,327 | 2/1970 | Eisler | 336/223 X |
| 3,634,632 | 1/1972 | Watson | 336/200 X |
| 4,651,254 | 3/1987 | Brede et al. | 336/200 X |

FOREIGN PATENT DOCUMENTS

| | | | |
|---|---|---|---|
| 151224 | 6/1937 | Austria | 336/223 |
| 1056272 | 4/1959 | Fed. Rep. of Germany | 336/200 |
| 1489053 | 5/1969 | Fed. Rep. of Germany | 336/223 |
| 61-184806 | 8/1986 | Japan | 336/225 |
| 665334 | 5/1979 | U.S.S.R. | 336/223 |
| 29274 | of 1913 | United Kingdom | 336/223 |
| 1094183 | 12/1967 | United Kingdom | 336/206 |

OTHER PUBLICATIONS

"Printed Circuit Coil", Styles, IBM Technical Disclosure Bulletin, vol. 15, No. 1, 6/72, p. 19, copy in 336-200.

*Primary Examiner*—Thomas J. Kozma

*Attorney, Agent, or Firm*—Jill M. Breedlove; James C. Davis, Jr.; Marvin Snyder

[57] ABSTRACT

A conductive film magnetic component such as an inductor or transformer includes a conductive film winding having a generally serpentine configuration when disposed in a plane. This film is folded to form a stack of layers with each "layer" comprising part of a winding turn and with successive "layers" connected at the folds via the continuous conductive film. The conductive film may be self-supporting and coated with a dielectric layer or may be disposed on a dielectric membrane. The film and membrane are preferably patterned photolithographically.

30 Claims, 12 Drawing Sheets

CONDUCTIVE FILM MAGNETIC COMPONENTS

The United States Government has rights in this invention pursuant to Contract No. N66001-87-C-0378 awarded by the Department of the Navy.

FIELD OF THE INVENTION

The present invention relates to the field of magnetic components, that is, inductors and transformers, and more particularly, to the field of conductive film magnetic components.

BACKGROUND INFORMATION

As the frequency of operation of a magnetic component such as an inductor or transformer increases, the depth to which current penetrates the transformer's conductors decreases. This penetration depth is referred to as the "skin depth". At room temperature, copper has a skin depth $\delta$ equal to $2.60\sqrt{1/f}$ where f is in Hertz. Thus, at a frequency of about 1 megahertz, the current penetration in copper is only on the order of 2.6 mils. Consequently, if the conductors are more than several skin depths thick, then any portion of the conductors which is further than $3\delta$ from the exterior surface is not involved in carrying the inductor or transformer currents. For high frequency operation, magnetic components are made as small as possible and, therefore, inactive conductive material adds to the weight and volume of the component without enhancing its operational characteristics. Consequently, for high frequency magnetic components, it has become commonplace to use a planar conductive film having a thickness on the order of twice the skin depth at the intended operating frequency as the magnetic component's conductors. These conductive films are normally disposed on a dielectric membrane and patterned to provide the desired winding configuration. Multi-turn windings normally comprise either a single layer spiral or a stack of layers of individual conductive films on dielectric substrates which are interconnected layer-to-layer with soldered connecting bars to provide a continuous winding. Spiral windings are limited in the number of turns they can provide for high currents and multilayer windings have the disadvantage of requiring a number of layer-to-layer connections which increases with the number of turns in a winding. Connecting thin conductive layers layer-to-layer with connecting bars which are soldered to the edge of a conductor is an exacting process which tends to have a poor yield since the solder can easily short out layers or fail to connect to a layer, which results in an inoperative winding.

Consequently, there is a need both for an improved method of fabricating multi-turn, multilayer thin film magnetic windings and for an improved structure which ensures good operating characteristics and which is easily fabricated.

OBJECTS OF THE INVENTION

A primary object of the present invention is to provide a thin film, multi-turn magnetic component winding structure which ensures uniformity from magnetic component to magnetic component.

Another object of the present invention is to provide a method of fabricating a thin film, multi-turn multilayer winding in a simplified manner which obviates the need for individual connections separately applied to each layer.

Another object of the present invention is to provide an easily fabricated and assembled conductive film transformer structure.

SUMMARY OF THE INVENTION

In accordance with the present invention, a multi-turn, multilayer thin conductive film magnetic component winding comprises a conductive film having a pattern which when folded upon itself, produces a multi-turn winding in which the layer-to-layer connections are built into the pattern of the conductive film in combination with the pattern of the folding of that film. Dielectric material spaces apart adjacent layers of the folded film conductor to prevent unintended connections between the different layers.

A multilayer, two-turn, center-tapped secondary winding is preferably provided by patterning a conductive film on a dielectric substrate in manner in which folding the dielectric substrate creates a stack of two-turn centertapped windings which are easily connected in parallel by soldering external terminals to exposed folds of the conductive film. Alternatively, a secondary winding may comprise a stack of individual conductive films.

DETAILED DESCRIPTION

The subject matter which is regarded as the invention is particularly pointed out and distinctly claimed in the concluding portion of the specification. The invention, however, both as to organization and method of practice, together with further objects and advantages thereof may best be understood by reference to the following description taken in connection with the accompanying drawings in which:

DETAILED DESCRIPTION

Figure 1:
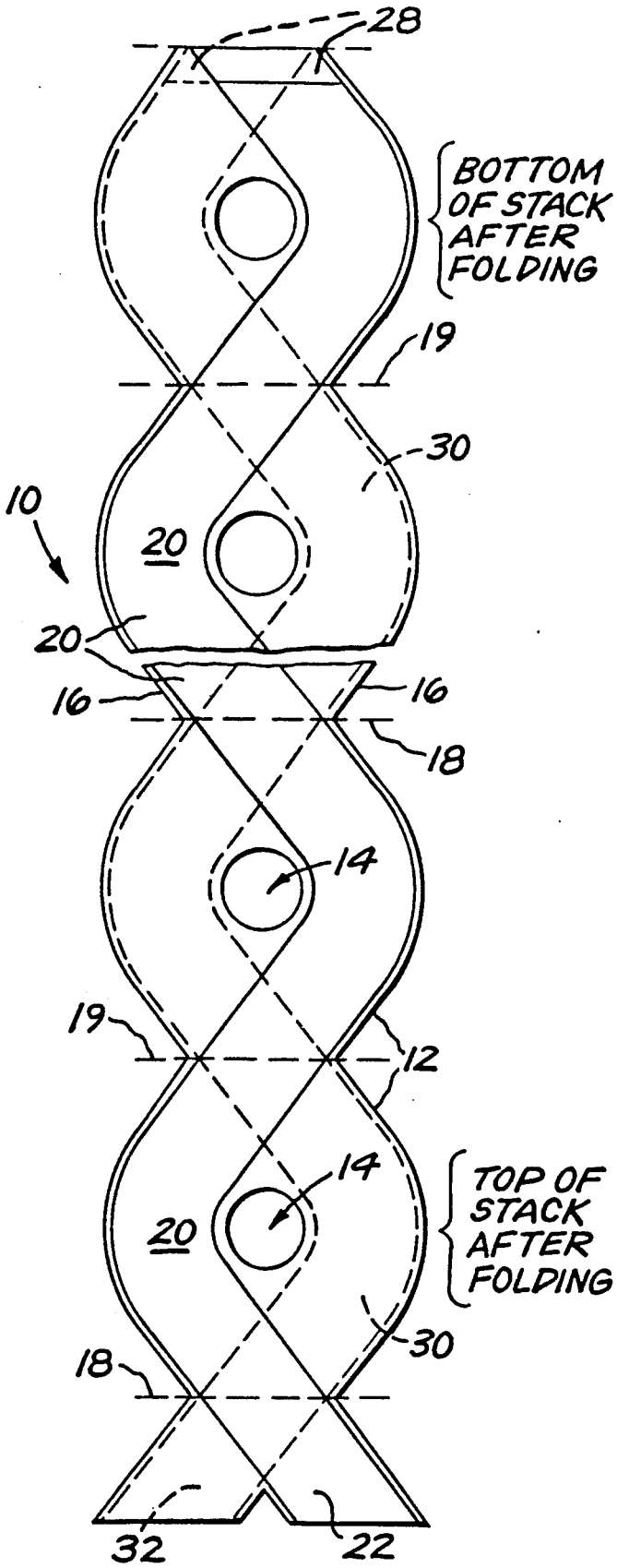
FIG. 1 is a plan view illustration of a multi-turn conductive film winding in accordance with the present invention prior to folding in which a half turn of the winding is present on each layer of the stack after folding.

Each winding of a transformer is itself an inductor. The two (or more) windings of a transformer are coupled by their mutual inductance. Thus, each of the windings described herein may serve as a stand alone inductor if it is not coupled to other windings or may serve as one of the windings of a transformer if it is inductively coupled to one or more other windings. The term "magnetic component" is used herein as encompassing inductors, transformers and other components which include a winding.

Different embodiments of windings in accordance with the present invention have been given reference numerals in different blocks of one hundred. Elements identified by reference numbers which end in the same two digits in different embodiments serve similar functions and in the interest of conciseness, are sometimes not discussed in connection with the later presented embodiments. In those situations, the reader is referred to the discussion of those elements in connection with earlier presented embodiments for an explanation of the element's function and structure.

A conductive film winding in accordance with the present invention is illustrated generally at 10 in FIG. 1 in a plan view prior to folding to form the multi-turn winding. Structurally, as illustrated, the winding comprises a dielectric membrane 12 having a plurality of apertures 14 therein and having an undulatory exterior boundary 16. A number of dashed lines 18 and 19 indicate the locations at which the membrane 12 is accordion or z-folded to form the winding. These fold lines are at the narrow portions of the membrane 12. A conductive film 20 disposed on the upper surface of the membrane 12 is of uniform width, has a terminal end 22 at the bottom of the figure and meanders the length of the substrate 12 in a serpentine manner to weave the conductive film alternately to the left of and then to the right of the successive apertures 14 in the substrate 12. This uniform width results in a current density within the film which is constant along the length of the film. The film 20 is illustrated with bold boundaries to indicate its location on top of the dielectric membrane or substrate 12.

A similar conductive film 30 having the same uniform width as film 20 is disposed on the lower surface of the dielectric membrane 12 and meanders in a serpentine or woven pattern around the apertures 14 in the membrane in the opposite sense to that in which the film 20 meanders. The film 30 is shown in dashed lines because it is behind the membrane 12. Film 30 has a terminal end 32 at the lower portion of the figure. The terminal ends 22 and 32 may be made wider than the remainder of the films 20 and 30 if that is considered beneficial in connecting the winding to other circuitry.

At the upper end of the figure, a connection 28 is provided between the film 20 and the film 30. The connection 28 may take any one of a number of forms. It is at this time considered preferable to solder, to both the upper conductive film 20 and the lower conductive film 30, a thin conductive foil which is folded on itself and which is the same thickness and width as or slightly wider than the films 20 and 30 in order to provide a continuous winding of uniform width. However, other techniques may be used if desired. These include, without limitation thereto, (1) depositing or laminating the films 20 and 30 as a single continuous film which is continuous at the connection 28 and (2) forming a via hole or holes through the dielectric membrane 12 at the location of the connection 28 and plating that through hole to connect the two conductive films 20 and 30.

With the connection 28 in place, the two films 20 and 30 form one continuous, uniform width, conductive strip having ends 22 and 32. As will be seen in the subsequent figures, the pattern in which the films 20 and 30 are disposed with respect to the apertures 14 and the manner of folding the membrane result in a single continuous winding 10 which encircles the apertures 14 in a manner in which, after folding, current flowing in the film from terminal 22 to terminal 32 continuously circles the apertures 14 in the same direction.

The winding 10 may be folded so that the terminals 22 and 32 are either at the top of the stack or the bottom of the stack. The following portion of this discussion assumes that winding 10 is folded with the terminals 22 and 32 at the top of the stack with conductor 20 exposed on top of membrane 12. This may be accomplished by z-folding the winding 10 at the fold lines 18 and 19 by pulling the fold lines 19 upward from the plane of the paper and pushing the fold lines 18 down below the plane of the paper in a manner to make an accordion-pleated stack of the segments of the winding 20 which are disposed between adjacent fold lines thereby forming a "stack" of winding layers. It is preferred to not fold the winding at the fold line 18 which is directly adjacent to the terminal ends 22 and 32 so that the terminal ends will protrude beyond the side of the stack of layers to facilitate formation of external electrical connections thereto. The winding 10 differs from prior art conductive film windings in that no connections between adjacent layers of the winding need to be made after "stacking" of the layers. Current flowing in film 20 from terminal 22 to connection 28 circles the apertures 14 (the axis of the winding) in a clockwise direction, when viewed from the top of the stack, as shown by the arrows in FIG. 2, as a result of the manner of folding and the manner in which serpentine film 20 meanders among the apertures 14. The serpentine film 30 meanders in the opposite sense, which combined with flow of current from connection 28 toward terminal end 32 also results in that current circling apertures 14 in a clockwise direction when viewed from the top of the stack.

Figure 2:
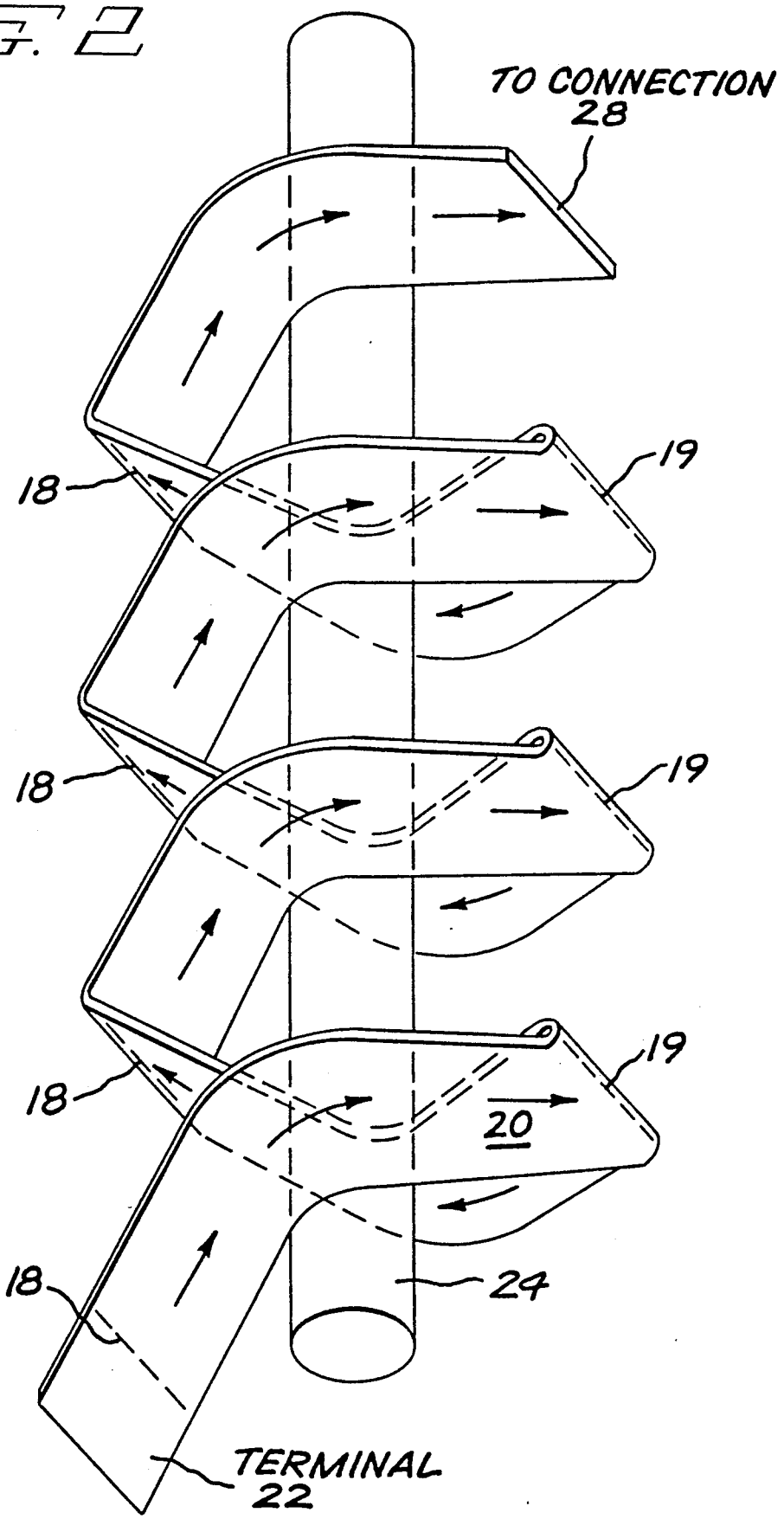
FIG. 2 is a perspective view of a partially folded film of FIG. 1 illustrating the manner in which folding provides multiple turns.

The conductor 20 of winding 10 is shown in perspective view from the top of the stack in a partially folded form in FIG. 2 to more clearly illustrate the manner in which folding of the conductive film of FIG. 1 results in a multi-turn winding which encircles a central core 24 in a single (clockwise) direction. In the event that these figures do not enable the reader to visualize the winding in its folded form, we suggest that the reader photocopy FIG. 1 and cut out the illustration along the outer boundary of membrane 12, cut or punch out the apertures 14 and fold this "paper doll" at the fold lines 18 and 19 to form the winding. This will enable the reader to visualize the configuration of the winding in its completed form.

Prior to folding the dielectric membrane 12 and the accompanying films 20 and 30, it is considered preferable to dispose dielectric layers over the exposed surfaces of the films 20 and 30 so that when folded as a stack, the conductive films do not form unintended electrical connections. The dielectric overlayer also provides additional environmental protection for the conductive film which helps to prevent chemical reactions between the film and the ambient environment in which it is used.

The winding 10 has been described as being comprised of the dielectric membrane 12 with the conductive films 20 and 30 disposed thereon. However, if desired, the conductive films 20 and 30 may comprise a single, continuous, self-supporting conductive film which has twice the length of the film 20 and a pattern in which, prior to folding, the serpentine configuration of the film 20 continues uninterrupted at the location of the "connection 28". The film in that configuration may then be coated with a dielectric layer as by dipping or spraying and after the dielectric layer has dried, may be folded at the connection 28 into the configuration illustrated in FIG. 1. Thereafter, it may be folded in an accordion fashion as has been described to provide a single winding with both its terminals at the same end of the multilayer stack. Alternatively, rather than folding such a long serpentine winding in the middle at the "connection 28" prior to the remainder of the folding, the entire winding may be accordion folded to place the two terminal ends of the winding at opposite ends of the completed stack. Finally, the long conductive film of this configuration may be disposed on a self-supporting dielectric membrane and folded in either of the manners just described.

Thus, either the dielectric membrane 12 may be a self-supporting layer or the conductive film may be self-supporting or both as may be desired in accordance with the desired thicknesses of the conductive film and the dielectric membrane.

Figure 3:
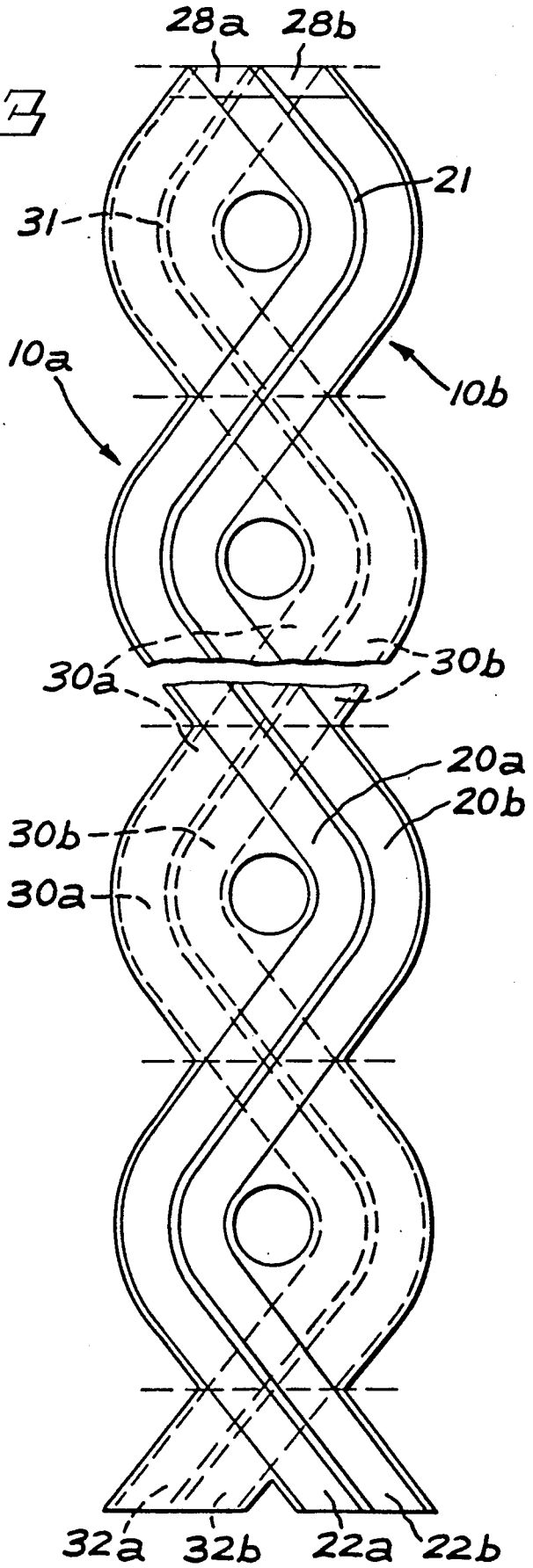
FIG. 3 is a plan view of a modified version of the FIG. 1 film which doubles the number of turns.

The winding 10 of FIGS. 1 and 2 may serve by itself as an inductor for use at high frequency and is capable of carrying high currents. Alternatively and preferably, the winding 10 may serve as one winding of a transformer for use at high frequencies. Where a 1:1 transformer ratio is desired, a second similar winding may be interleaved with the winding 10 to serve as the other winding of the transformer. Alternatively, the films 20 and 30 may each be divided into two films by lengthwise extending gaps 21 and 31 to form films 20*a* and 30*b* and 30*a* and 30*b* as shown in FIG. 3. Films (20*a* and 30*a*) and (20*b* and 30*b*) form two separate windings 10*a* and 10*b*, respectively, having terminal ends (22*a* and 32*a*) and (22*b* and 32*b*), respectively. These windings 10*a* and 10*b* may serve as the primary and secondary, respectively, of a 1:1 turns ratio transformer. Alternatively the windings 10*a* and 10*b* may be connected in series by connecting terminal end 22*b* to terminal end 32*a* to thereby provide an overall winding having twice as many turns, but half the width and thus half the current carrying capacity of winding 10.

Where a high turns ratio is desired, the winding 10 preferably serves as the winding having the larger number of turns and a separate winding having a different configuration serves as the winding having the smaller number of turns.

Figure 4:
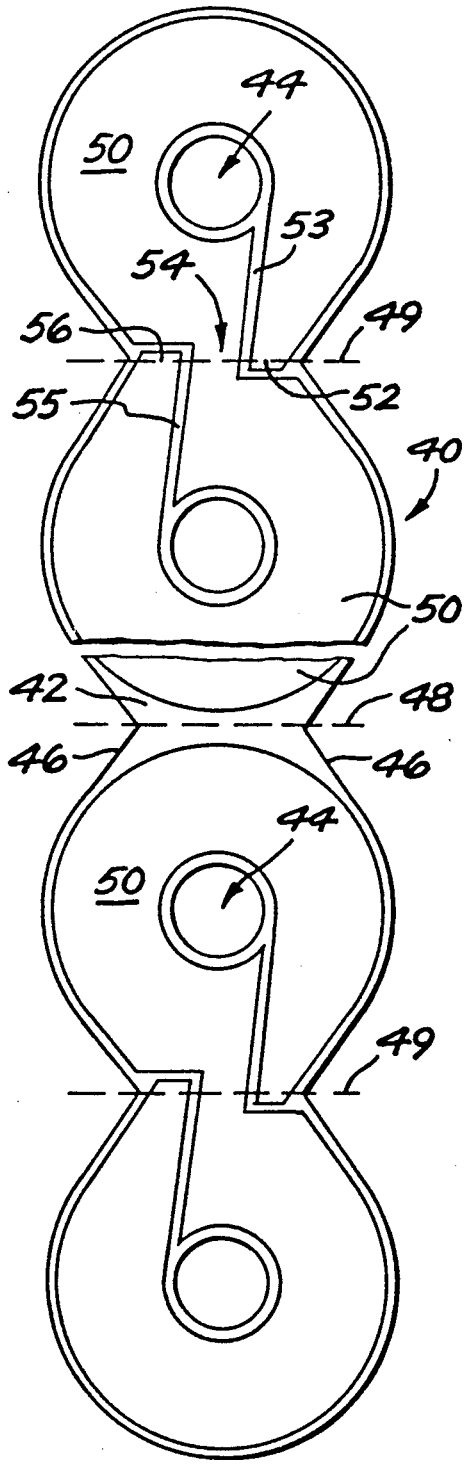
FIG. 4 is plan view of a two-turn, center-tapped multilayer winding in accordance with the present invention.

A center tapped, multilayer, secondary winding 40 in accordance with the present invention in which each half of the secondary winding comprises a single turn is illustrated in plan view in FIG. 4 prior to folding. After folding, this winding may be interleaved with the winding 10 of FIG. 1 to form a step-down transformer having a centertapped secondary winding. Those skilled in the transformer art will recognize that either winding 10 or winding 40 may serve as the primary, but that normally in a transformer having one two-terminal winding and one center-tapped (three-terminal) winding, the center-tapped winding is thought of as the secondary winding.

The winding 40 is similar to the winding 10 in being formed on a dielectric membrane 42 having a plurality of apertures 44 therein along with an undulatory exterior boundary 46. Fold lines for the membrane 42 are illustrated by the dashed lines 48 and 49. The winding 40 comprises a plurality of conductive films 50, each of which comprises a two-turn, center-tapped winding. As illustrated, the film 50 at the top of the figure has a terminal end 52 which is disposed on the right just below the fold line 49 and from there extends upward to the right of, around and across above the upper aperture 44 in the membrane 42, back down the left side of that aperture, back across the fold line 49, down around the right side of the next aperture in the membrane 42, around underneath that aperture, back up to and just across the fold line 49 at the left side of the membrane 42 in the figure to a terminal end 56. A portion 54 of the film 50 which spans the fold line 49 and is separated from the terminal ends 52 and 56 by gaps 53 and 55 in the conductive film 50, serves as the center-tap terminal of this winding. It is preferred to provide a dielectric overlayer on top of the winding 50. This is necessary for electrical isolation where the fold line 49 is pulled up out of the plane of the paper and the fold lines 48 are pushed down below the plane of the paper in folding the winding 40 in order to insulate adjacent windings from each other since in the preferred manner of interleaving the primary and secondary windings, the top half of the next lower film 50 faces the bottom of the top film 50 without other insulation therebetween. As illustrated in FIG. 4, the terminal portions 52, 54 and 56 of the winding 40 are each narrower than the portion of the films which extend around an aperture 44. These widths may be made substantially equal by making the "waist" of the FIG. 8 wider, i.e. making the membrane 42 and the film 50 wider at the horizontal centerline of the FIG. 8 (which coincides with the fold line 49).

Figure 5:
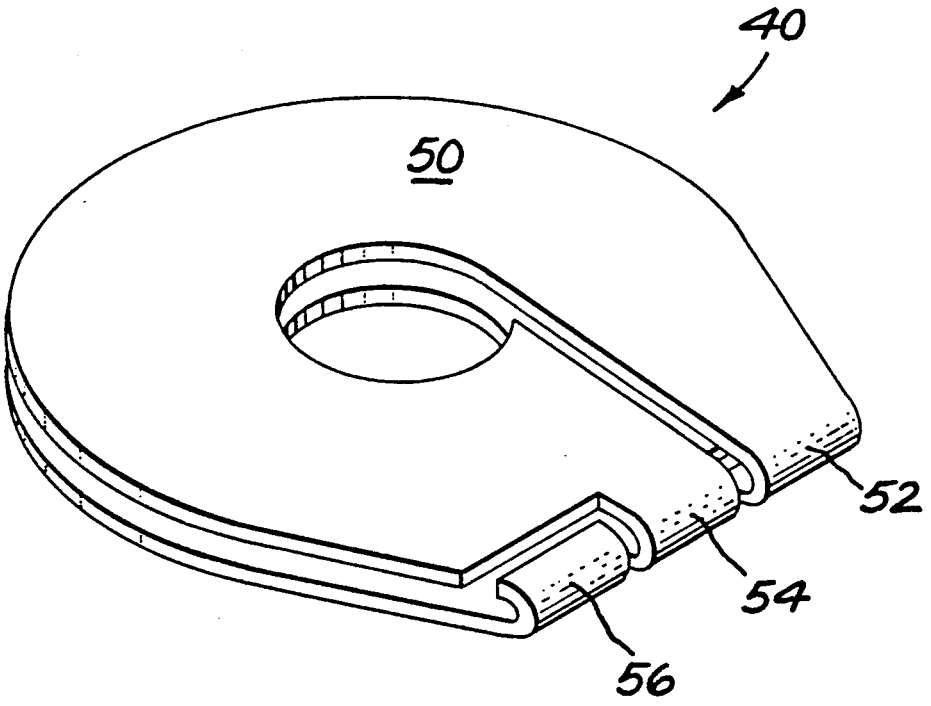
FIG. 5 is a perspective view of one layer of the winding of FIG. 4 in a folded condition illustrating folds to which external terminals may be soldered.

FIG. 5 illustrates, in perspective view, one of the films 50 in its folded configuration in which the terminal portions 52, 54 and 56 of the film 50 are exposed at the side of the stack. The dielectric membrane 42 is not shown in FIG. 5. The folds facilitate connection of the separate films 50 in parallel, since a first terminal strip 52T (FIG. 8) may be soldered to the terminal portion 52 of each of the films 50, a second terminal strip 54T may be soldered to the terminal portion 54 of each of the films 50 to serve as the center-tap terminal and a third terminal strip 56T may be soldered to the terminal portion 56 of each of the windings 50 to serve as the other outer terminal of the multilayer, two-turn, center-tapped secondary winding. This connects the films 50 in parallel to provide a high current capacity two-turn center-tapped winding. This is more clearly illustrated in FIG. 8.

In the event it were desired to double the number of layers in the secondary winding 40, a plurality of identical conductive films could be formed on the opposed surface of the membrane 42. In order to connect those additional films to the terminal strips 52T, 54T and 56T, those additional films should be connected in the vicinity of the terminal portions 52, 54 and 56 to the films 50 via plated through via holes in the dielectric membrane 42 or by other techniques such as having two tab portions of the backside film extending laterally in the vicinity of the fold line 49 as terminal ends 52 and 56. Those two tabs can then be folded over onto the front side winding and soldered to terminal ends 52 and 56 of film 50. Then only the center tap terminal of the backside winding needs to be connected to the front side film by a via. The provision of the additional films on the back of membrane 42 increases the current carrying capacity of the overall secondary winding.

Figure 6D:
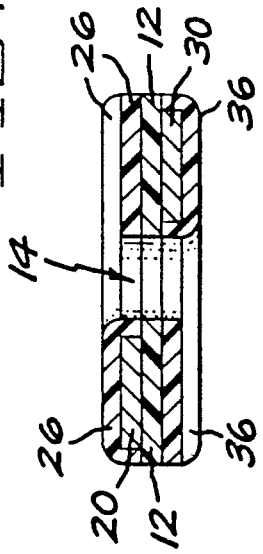
FIGS. 6C and 6D are cross-section illustrations of the FIG. 6A structure taken along lines 6C—6C and 6D—6D, respectively.
Figure 6C:
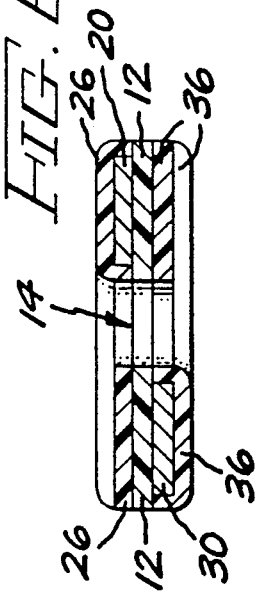
Figure 6A:
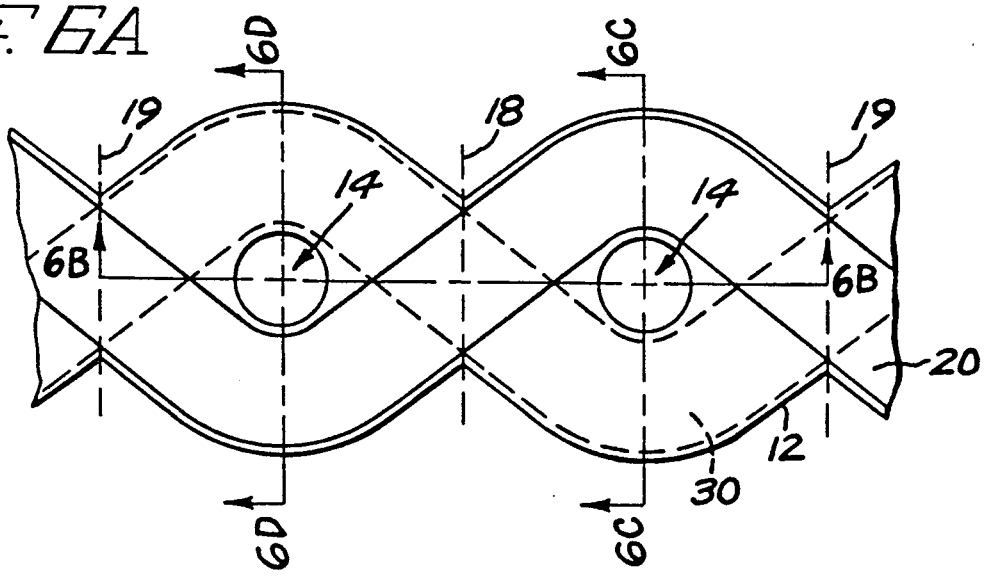
FIG. 6A is a plan view illustration of a portion of the FIG. 1 structure.
Figure 6B:
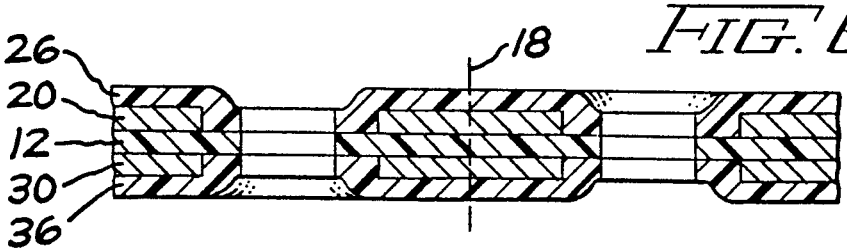
FIG. 6B is a cross-section illustration of the FIG. 6A structure taken along the line 6B—6B in FIG. 6A.

FIG. 6A illustrates slightly more than one complete cycle of the serpentine path of conductor films 20 and 30 and for that portion is identical to a corresponding period of the FIG. 1 structure. FIG. 6B, directly below FIG. 6A, is a cross-section through FIG. 6A taken along the line 6B—6B which extends parallel to the length of the winding and extends through the center of each of the apertures 14 therein. FIG. 6B is vertically aligned with respect to FIG. 6A such that the fold line 19 and two apertures 14 are aligned in FIGS. 6A and 6B. In FIG. 6B, the vertical or thickness direction of the layers is greatly exaggerated relative to the horizontal or lengthwise dimension of the layers in order to clearly illustrate the layers. In a particular physical embodiment of the winding of FIG. 6A intended for use at about 2 MHz, the distance between the fold lines 18 and 19 is about 0.52 to 1.00 inch and the maximum width of the dielectric membrane 12 is about the same. In such a physical embodiment, the membrane 12 is preferably about 1–3 mils thick, each of the conductive films 20 and 30 is preferably about 2.5 mils thick, and the dielectric overcoats 26 and 36 are preferably about 0.5–2 mils thick. Thus, the horizontal dimension between a fold line 18 and an adjacent fold line 19 is about 50–100 times the entire thickness of the cross-section shown in FIG. 6B. Thus, the manner of folding the structure of FIG. 6B is not visually apparent in FIG. 6B. In such a physical embodiment, the apertures 14 are preferably about ¼ inch in diameter. FIGS. 6C and 6D are cross-sections through the winding 10 whose cut lines are oriented perpendicular to the length of the winding. The cut lines for FIGS. 6C and 6D extend through the centers of successive apertures 14 along the length of the winding 10. FIGS. 6C and 6D are above FIG. 6A in the drawings and are aligned with their associated section lines in FIG. 6A.

In FIG. 6B, the conductive film 20 passes behind the righthand aperture 14 as may be seen more clearly in FIG. 6C. This causes the dielectric overcoat 26 in FIG. 6B, at a distance behind the aperture 14, to be flush with the portions of the dielectric overcoat 26 at the cross section cut where the dielectric 26 overlies the film 20. At the lefthand aperture 14, the film 20 passes in front of the aperture as may be seen more clearly in FIG. 6D. Consequently, in FIG. 6B, the dielectric overcoat 26 behind the lefthand aperture 14 is at a lower level than (depressed relative to) the portion of the overcoat 26 which overlies the film 20 at the cross-section cut. This is because of the absence of the thickness of the film 20 behind the lefthand aperture 14. In a similar manner, the dielectric overcoat 36 on the lower surface is flush behind the lefthand aperture and depressed inward behind the righthand aperture.

Figure 7:
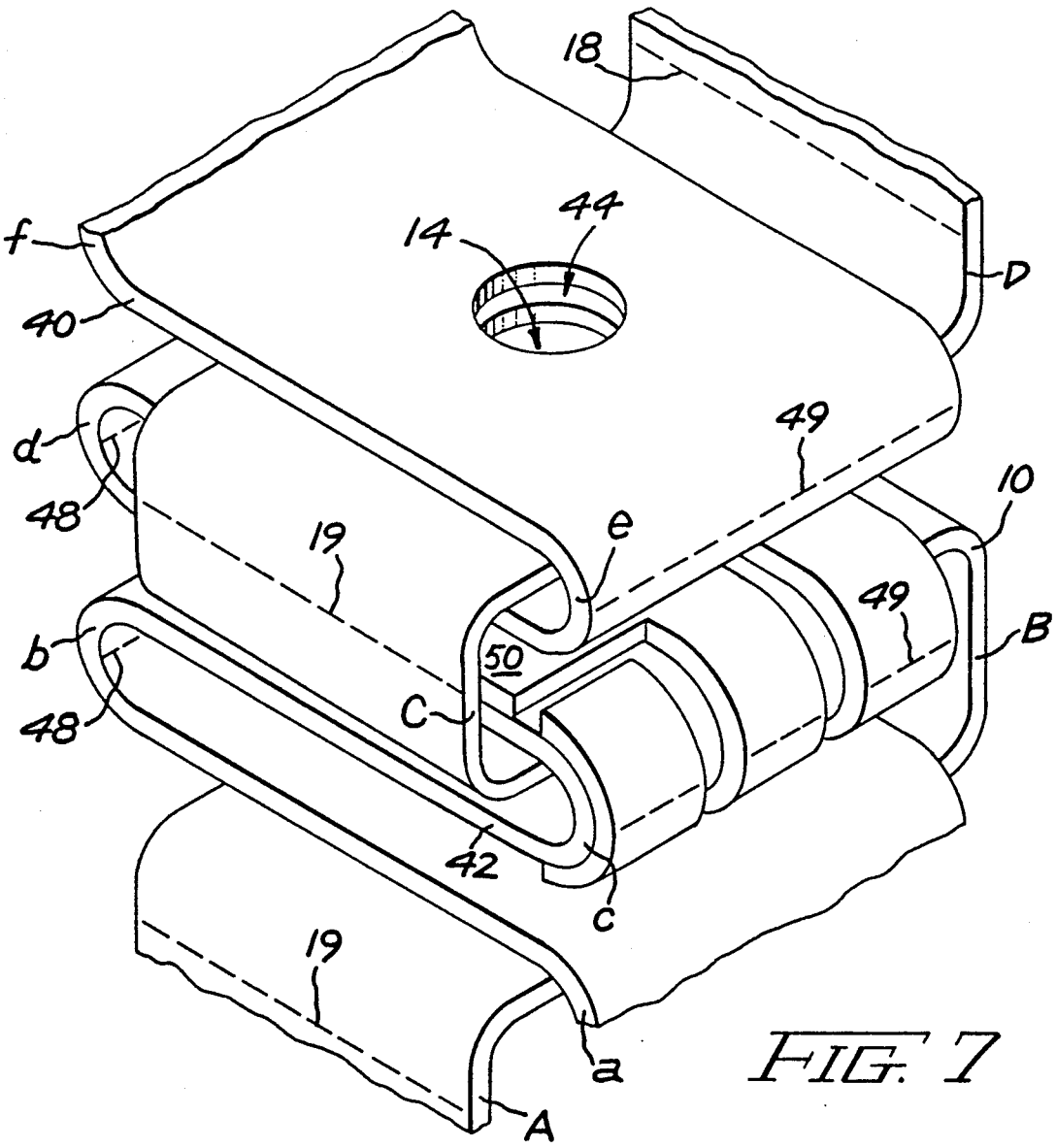
FIG. 7 is a schematic illustration of a preferred manner of interleaving the windings of FIGS. 1 and 4.
Figure 8:
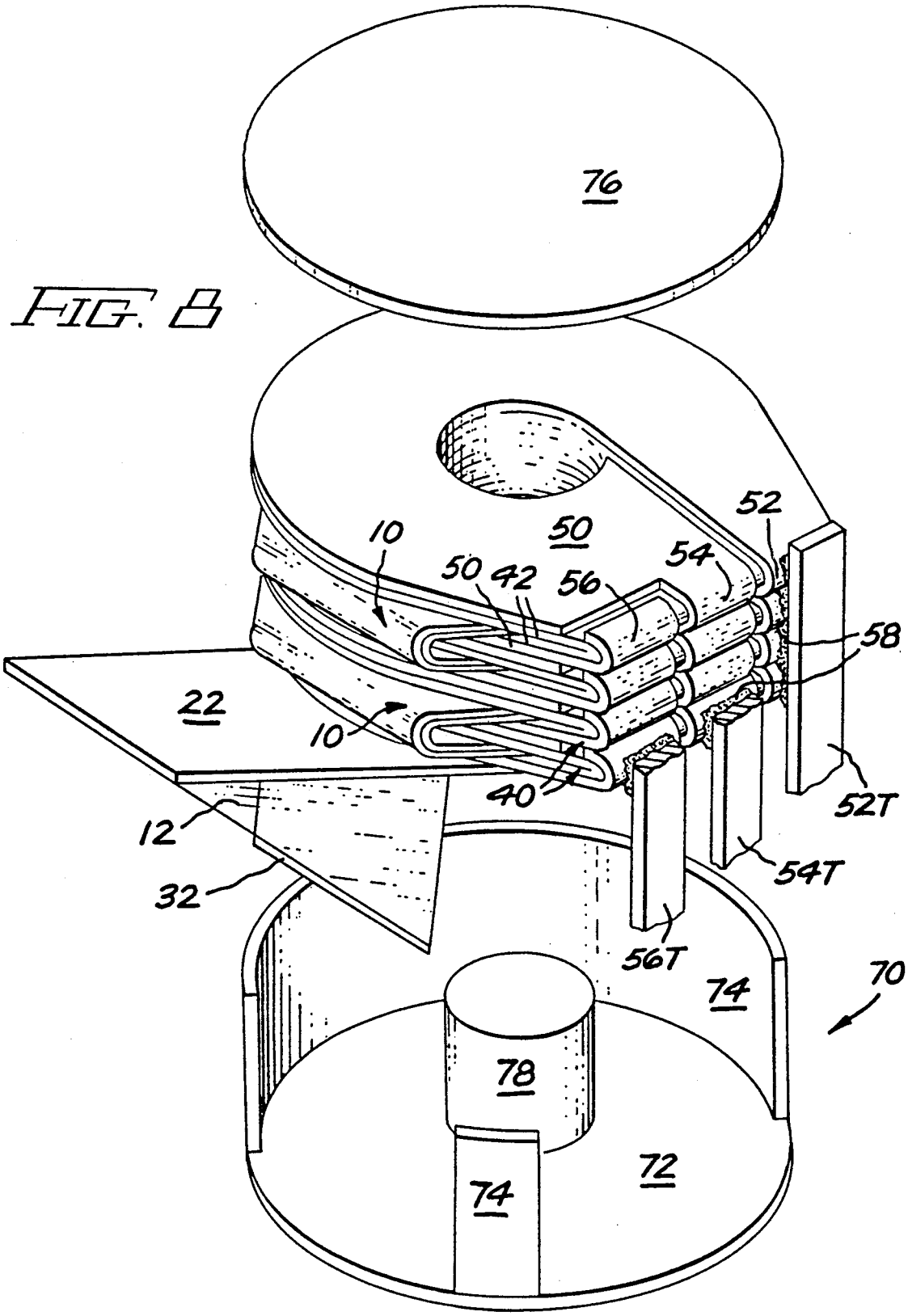
FIG. 8 is a perspective, exploded illustration of the windings of FIGS. 1, 2 and 4–6 in a magnetic cup core in which they are disposed to form a transformer.

FIG. 7 is a schematic illustration of a preferred manner of interleaving the primary and secondary windings. The fold lines 18 and 19 of winding 10 are disposed perpendicular to the fold lines 48 and 49 of secondary winding 40. Successive folds in the winding 10 are identified by capital letters beginning with "A" at the bottom of the figure. Successive folds in the winding 40 are identified by lower case letters beginning with "a" at the bottom of the figure. There are essentially twice as many layers of the secondary winding as there are layers of the primary winding. The secondary winding at the fold lines 49 where the terminal ends 52, 54 and 56 are located preferably has a layer of the primary winding disposed "inside" it. This is illustrated in the vicinity of fold "c" in the secondary winding where the metal of that winding has been included in the figure. The metal is omitted elsewhere for drawing clarity. This manner of interleaving increases the vertical length of the exposed surfaces of the terminals 52, 54 and 56 which is available for soldering to external terminal strips as is shown in FIG. 8 to be discussed subsequently. It will be noted in FIG. 7 that the secondary winding films 50 face each other separated only be a dielectric overcoat, but are spaced from the primary winding by the dielectric membrane 42 plus any dielectric overcoat on the primary winding. Only a low voltage is present across adjacent secondary winding turns, while higher voltages are present between some of the secondary winding turns and the adjacent primary winding turns. The membrane 42 is selected to withstand these higher voltages.

With twice as many folds (and layers) in the secondary windings as the primary and with uniform interleaving as shown in FIG. 7, the folds in the two windings cannot be disposed parallel to each other. If they were disposed parallel, some of the folds would interfere with the uniform interleaving. The windings are shown with their folds perpendicular for clarity of illustration. With the windings having the shape shown in FIGS. 1 and 4, the windings can be interleaved with their folds in between parallel and perpendicular. However, perpendicular folds are preferred since that provides a more uniform structure.

For a transformer in which there are essentially the same number of folds and layers in each winding, the interleaving can be done with the fold lines of the different windings disposed parallel. However, this is not preferred because inserting one folded edge directly into another folded edge results in a thicker winding stack than when the fold lines of the windings are disposed perpendicular.

In FIG. 8, the resulting interleaved stack of layers of the primary winding 10 with layers of the secondary winding 40 is shown in an exploded, stylized view with a magnetic cup core 70. In FIG. 8, the layers of the winding 10 visible at the front of the drawing are illustrated schematically as extending between two successive layers of dielectric membrane 42. This is to avoid cluttering FIG. 8 with so much detail as to become meaningless. As has been discussed just above, the layer of the winding 10 which is inserted between the two layers of membrane 40 which are associated with a single film 50 of the secondary winding has a total thickness of from about 5 mils to about 11 mils. For a dielectric membrane 42 thickness of 1–3 mils and a conductive film 50 thickness of 1-3 mils, a single thickness of the secondary has a thickness of 2-6 mils, and a "folded" thickness of 4-12 mils, which, with the 5-11 mil thick primary winding layer inside the fold provides the folded edge of the film 50 at terminal portions 52, 54 and 56 with a total height of from about 12 mils to about 23 mils. The manner of soldering the terminal strip 52T to the terminal portions 52 of successive layers of the secondary winding is illustrated at the far righthand portion of FIG. 8. The solder layer 58 which connects the terminal strip 52T to the terminal portions 52 of the layers of the secondary winding bonds to the folded edges of these layers and extends between the layers in a manner which provides a solder bond having a vertical extent along each fold which is substantially equal to the 12-23 mil overall distance between the uppermost surface of the film 50 and its lowermost surface. The actual length of the solder bond is greater than that because of the curved nature of the fold and the manner in which the solder follows that fold to the point where the dielectric overcoat (not shown) on the top film 50 contacts the dielectric overcoat (not shown) on the next lower film 50 or the foldover portion of terminal 52 stops, or where the fold-over portion of terminal 52 contacts the non-fold-over portion of the next lower terminal 52. The terminal strips 54T and 56T are soldered in a similar manner, but are shown cut away in FIG. 8 for drawing clarity. This 12-23 mil "thickness" of the solderable edge 52 of a 1-3 mil film is 12-8 times the thickness of the edge of a single 1-3 mil film to which a solder connection is made in the primary winding of a prior art thin-film transformer made of successive layers which are connected by soldered-on minuscule connector bars. Thus, the present invention provides a much better surface for making low resistance solder connections between the terminal portions of the film 50 and the terminal strips than is the case in the prior art structures.

Further, in the prior art, each of the connector strips is separately connected to the ends of two adjacent turns of the primary winding. Thus, each connector strip has to be isolated from other layers. In contrast, in the structure shown in FIGS. 1, 2 and 4-8, each of the three terminal strips 52T, 54T and 56T (FIG. 8) is much longer and connects to each of the layers and is properly isolated by avoiding solder bridges to the other terminal strips and wrong terminal ends of the individual winding layers. Further, the folded terminal ends are held in fixed relation to each other by the dielectric membrane 42, thereby obviating any need to hold individual films in place during soldering. Thus, attaching the terminal strips 52T, 54T and 56T is much simpler than attaching the connector "bars" of prior art layered primary windings.

The magnetic cup core 70 has a lower disk-shaped cap 72, a vertically extending sidewall 74 and an upper disk-shaped cap 76. The cup core 70 includes a central post 78 which extends through each of the apertures 14 and 44 in the dielectric membranes 12 and 42 on which the films 20 and 50 are disposed. As illustrated, the sidewall 74 has a first aperture therein through which the terminal ends 22 and 32 of the primary winding extend and a second aperture through which the terminal portions 52, 54 and 56 of the secondary winding extend. When the cover 76 is in place in direct contact with the sidewalls 74 and the central post 78, a single magnetic structure encloses the entire transformer winding.

It will be noted that the winding 10 and each half of the secondary winding 40 each comprise the same number of physical turns encircling the apertures in the conductive membranes. By interleaving the folds of these windings as illustrated in FIG. 7, a secondary winding conductive film 50 brackets each layer of primary winding 10 (a half turn in film 20 and a half turn in film 30) in a manner to provide direct, close coupling between the primary and secondary windings. In this manner, the current carrying capacity of the secondary winding and the current which can be extracted therefrom are both rendered relatively high and losses are significantly reduced.

While FIG. 8 illustrates a circular cup core and the terminals of the windings disposed at 90° to each other, it will be recognized that other core shapes and other terminal locations may be employed if desired.

As the size of the transformer shrinks with increasing frequency, use of a rectangular core having "corner" or end "posts" connecting the upper and lower caps at the outside becomes preferable because it allows for protrusion of the folds in the dielectric in the spaces between the "posts" while maintaining the magnetic structure as close to the conductors of the windings as possible. This rectangular "post" core is especially useful with transformers in which both the primary and the secondary are z-folded and their fold lines are oriented perpendicular to each other as shown in FIG. 7.

In this way, a conductive film transformer is provided in which only the multiple layers of the secondary winding are soldered to external terminals in a stacked configuration, but at folded edges of the conductive films. Consequently, the present transformer is substantially less complex to manufacture and assemble than is a prior art conductive film transformer and is substantially more reliable.

The winding 10 may preferably be formed by providing a dielectric sheet having separate conductive films disposed on its upper and lower surfaces. The two conductive films 20 and 30 are then defined by photolithographic patterning of the conductive films on the top and bottom surfaces, respectively, and etching or otherwise removing the portions of those continuous films which do not form a part of the respective patterned films 20 and 30. Thereafter, the dielectric membrane 12 itself is preferably patterned to leave the dielectric membrane 12 protruding slightly beyond the conductive films and having the apertures 14 therein either by die cutting or by photolithographically patterning and etching the dielectric membrane. The winding 40 may be formed in a similar manner from a dielectric sheet having a conductive film disposed only on the top surface thereof. Once the conductive film pattern and the dielectric membrane pattern have been formed, the windings are folded at the fold lines into their stacked forms which have been described. Where the winding is formed in this manner, it is preferred to have the conductive film set back from the edge of the dielectric in order to ensure that the conductor is insulated from the magnetic core in which it is inserted.

Alternatively, where a particularly compact structure is desired, the conductive film may be a self-supporting foil which is coated with a thin dielectric after patterning. Thin dielectric coatings may preferably be applied electrophoretically to ensure adequate coating of edges and corners without producing excessive thicknesses on the wide surfaces. Electrophoretic deposition is explained more fully in "Electrodeposition of Polymers from Nonaqueous Systems. I. Polyimides: Some Deposition Parameters" by W.M. Alvins et al., Journal of Applied Polymer Science, Volume 27, 1982, pages 341–351, which is incorporated herein by reference. Other dielectric coating techniques may be used as desired and include dipping in varnish, spraying and so forth. Although not preferred because of the spacings required, air dielectrics may also be used.

Figure 9:
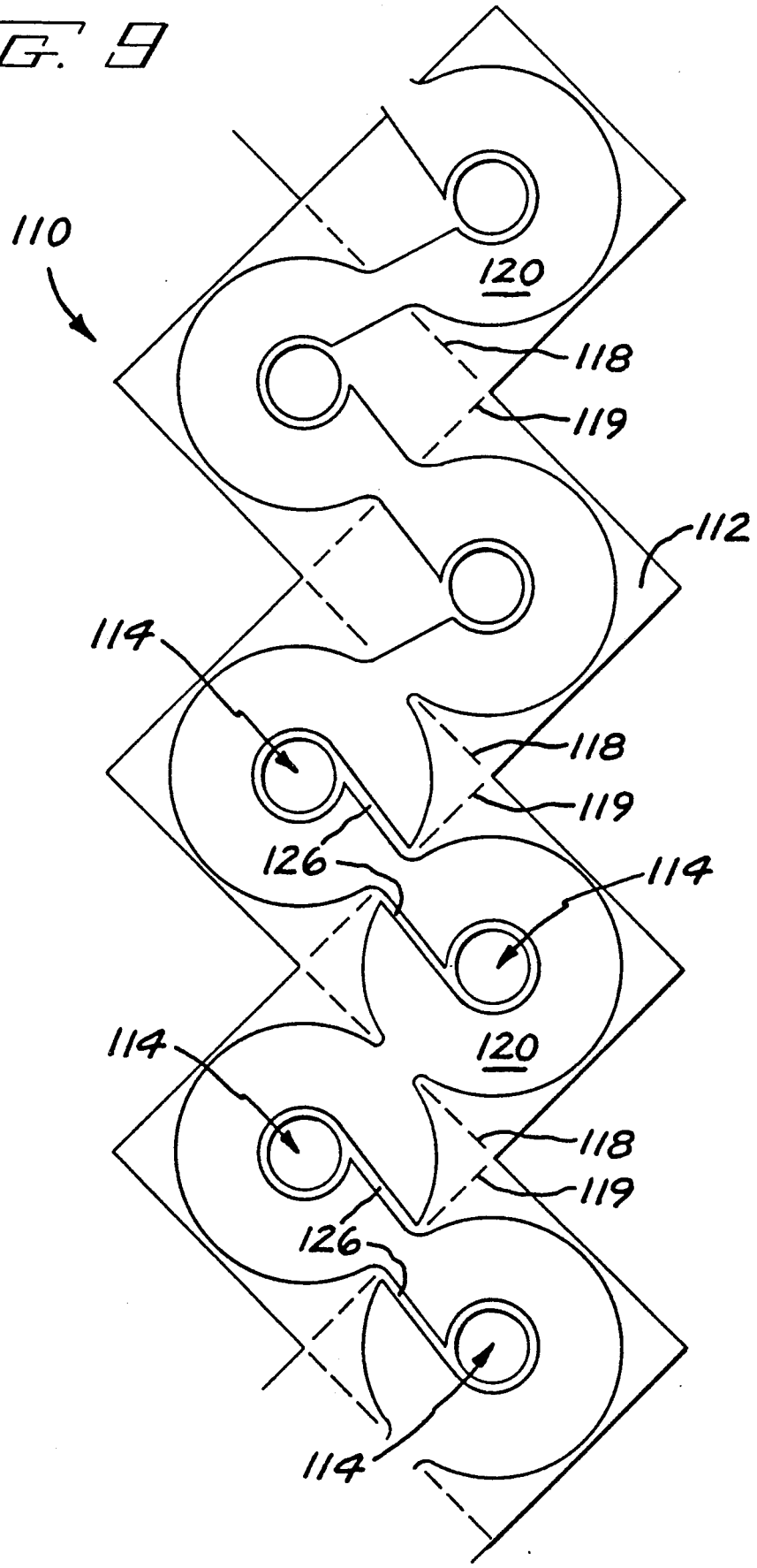
FIG. 9 is a plan view of an alternative embodiment of a multi-turn winding in accordance with the present invention in which each layer, after folding, comprises three-quarters of a turn of the winding.

An alternative conductive film pattern for a multiturn winding is illustrated in plan view prior to folding in FIG. 9 as a winding 110. The winding 110 comprises three-quarters of a turn of the winding in each layer of the final, stacked, folded configuration. To provide this three-quarters of a turn, the fold lines 118 and 119 are disposed at right angles to each other rather than parallel to each other as with the winding 10. The conductive film 120 is illustrated in the top portion of FIG. 9 as having a piece-of-pie-shaped portion missing from an otherwise substantially circular, annular conductive pattern on each square of membrane 112. In the lower portion of FIG. 9, the conductive film forms a complete annulus except for a narrow gap 126 which extends from the outer edge of the annulus to its central hole at aperture 114. Either of these configurations is effective in controlling the path followed by current flowing through the winding to restrict it to flowing in the three-quarter turn path which encircles the central apertures 114 in the membrane 112. The film 120 is formed into a multi-turn winding by folding the membrane at fold line lines 118 and 119 by lifting the fold lines 119 out of the plane of the paper and pushing the fold lines 118 down below the plane of the paper.

In FIG. 9, the membrane 112 is illustrated as a stair step pattern of square segments which form the separate layers of the stack after folding. This is for illustrative purposes to indicate that the dielectric membrane can have a different shape than the conductive film. However, it is considered preferable to have the dielectric membrane closely follow a circle which is just larger than the exterior boundary of the conductive film in order to provide a substantially circular stack for insertion into a cup core to form the final inductor or transformer while providing isolation which prevents contact between the conducting film and the enclosing ferrite cup core.

Figure 10:
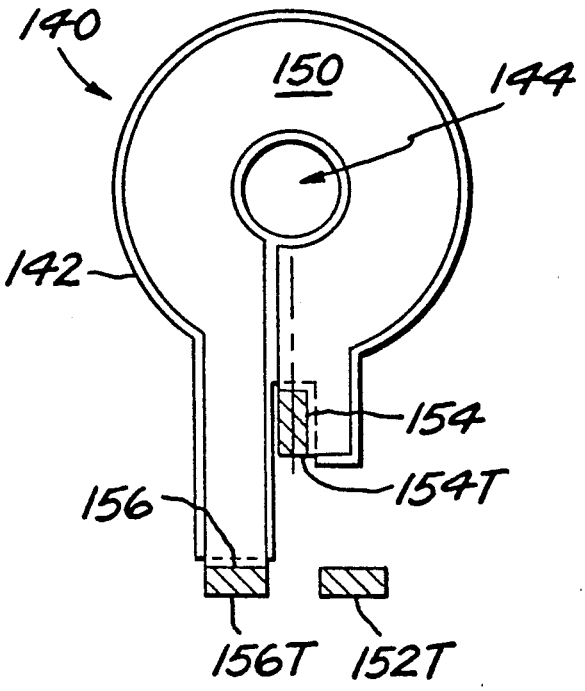
FIG. 10 is a plan view of a single layer of an alternative embodiment of a multilayer secondary winding.

In FIG. 10, a single turn of one side of a secondary winding 140 is illustrated in plan view along with cross-sectional illustrations of terminal strips 152T, 154T and 156T to which the individual winding turns are attached. It will be noted that the conductive film 150 illustrated in FIG. 10 makes contact only to the terminal strip 156T and the terminal strip 154T because the conductive film "terminal end" in alignment with strip 152T is too short to reach that terminal strip.

Figure 11:
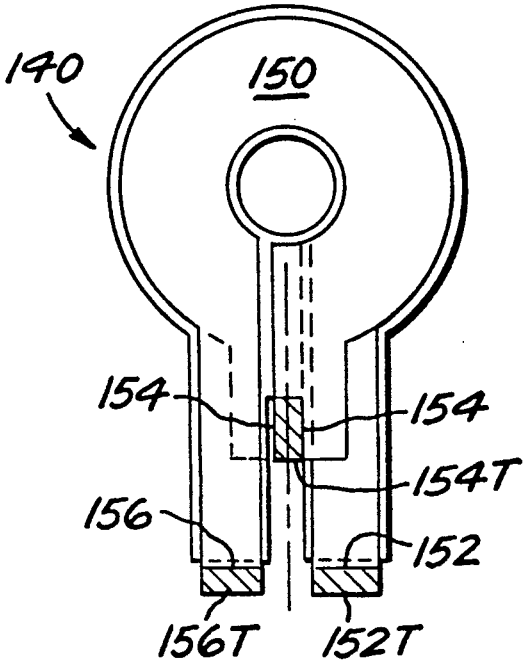
FIG. 11 is a plan view illustrating the manner of stacking the winding layers of FIG. 10 to form two, multilayer, single turn windings having a common terminal, i.e. a two-turn center-tapped winding.

In FIG. 11, two of the films 150 of FIG. 10 are illustrated superimposed with the lower one flipped over relative to the upper one. The dielectric membrane between the films is omitted for clarity. In this configuration, it can be seen that films in the configuration shown in FIG. 10 connect to the terminal strips 156T and 154T, while the flipped version of that film connects to the terminal strips 154T and 152T to thereby provide turns of the two halves of the secondary winding in accordance with the orientation in which each film 150 is added to the stack. This orientation may preferably alternate.

The individual conductor layers of FIGS. 10 and 11 may also be formed directly from a conductive film such as copper foil and then coated with insulation by dipping or spraying with a varnish or by electrophoretic deposition.

Figure 12:
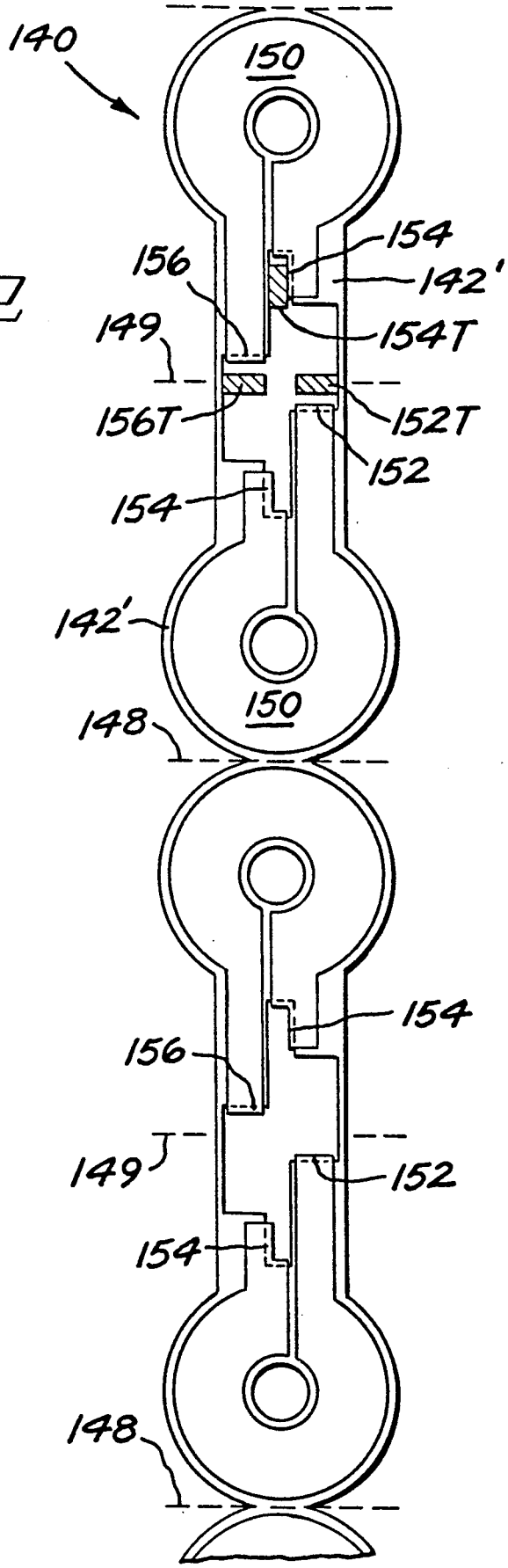
FIG. 12 is a plan view illustration of a manner of fabricating the winding of FIG. 11 as a foldable winding.

In FIG. 12, the film patterns of FIGS. 10 and 11 are illustrated in a continuous dielectric membrane strip form similar to FIG. 4 in which the individual winding layers are defined in the conductive film, the dielectric material of membrane 142' is removed at least in the vicinity of the terminal connections and the dielectric membrane is then folded to form the multilayer stack of winding layers. In FIG. 12, one set of terminal strips 152T, 154T and 156T is illustrated for orientation purposes. After folding on the fold lines 148 and 149, the winding 140 is positioned in contact with the terminal strips 152T, 154T and 156T and soldered to each of the terminal strips.

Figure 13:
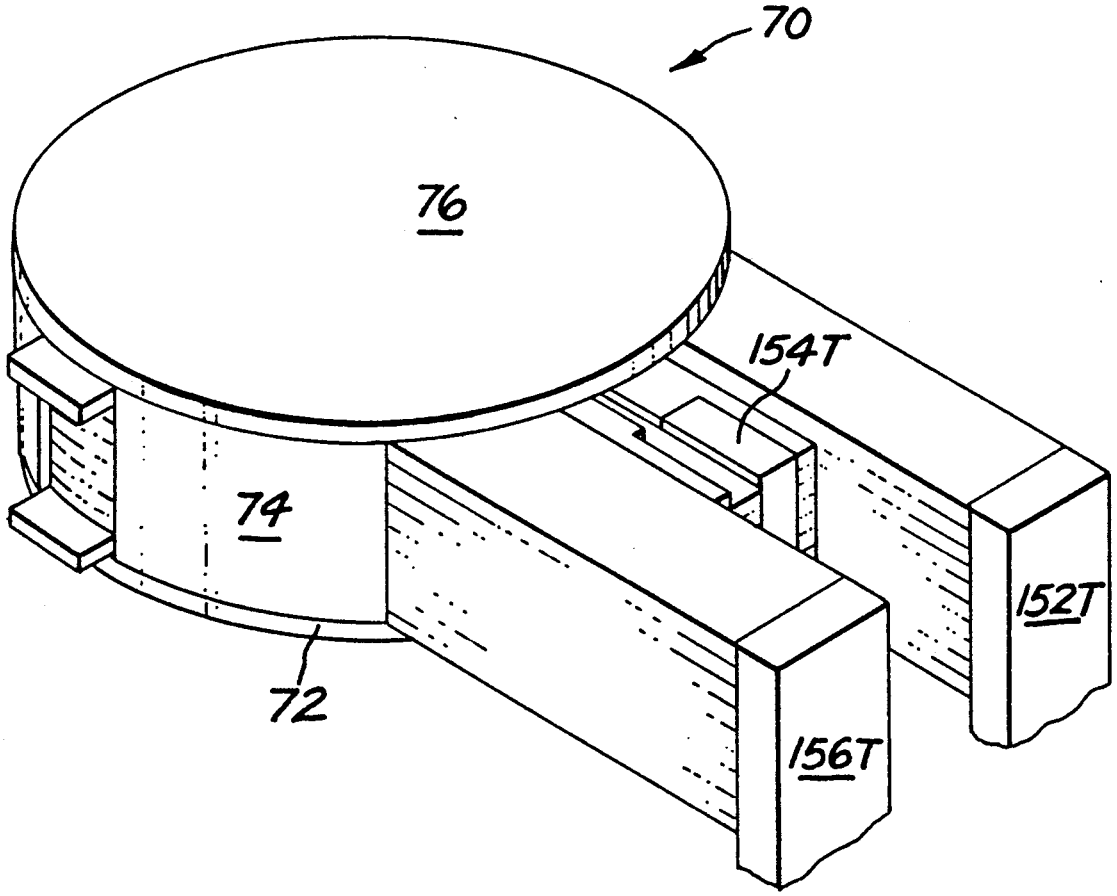
FIG. 13 illustrates a transformer comprised of the winding of FIGS. 9 and 11 in a cup core.

In FIG. 13, a transformer comprised of the winding 110 and the windings 140 is illustrated in a closed cup core package ready for installation in a system for use. In FIG. 13, the two terminal ends of the primary winding are disposed at opposite ends of the stack and extend at 90° to the secondary terminal legs. The extension of the secondary terminals in FIG. 13 outside the core is greatly exaggerated for drawing clarity and in physical embodiments is normally minimized.

Unsupported secondary windings of the type shown in FIGS. 10–12 are most useful at frequencies such as from about 250 KHz to about 1.0 MHz. This is because at those frequencies the conductor film must be relatively thick in order to be approximately 2 skin depths thick, ranging from about 10.4 mils at 250 KHz to about 5.2 mils at 1 MHz. These relatively thick films provide a relatively thick edge for soldering to the terminal posts. However, these windings may be used at higher frequencies, if desired.

Secondary windings of the type shown in FIGS. 4–8 are most useful at relatively higher frequencies above about 1 MHz. This is because as the operating frequency increases, the required thickness of the conductive film decreases thereby complicating edge soldering. However, these windings may be used at lower frequencies, if desired.

Figure 14:
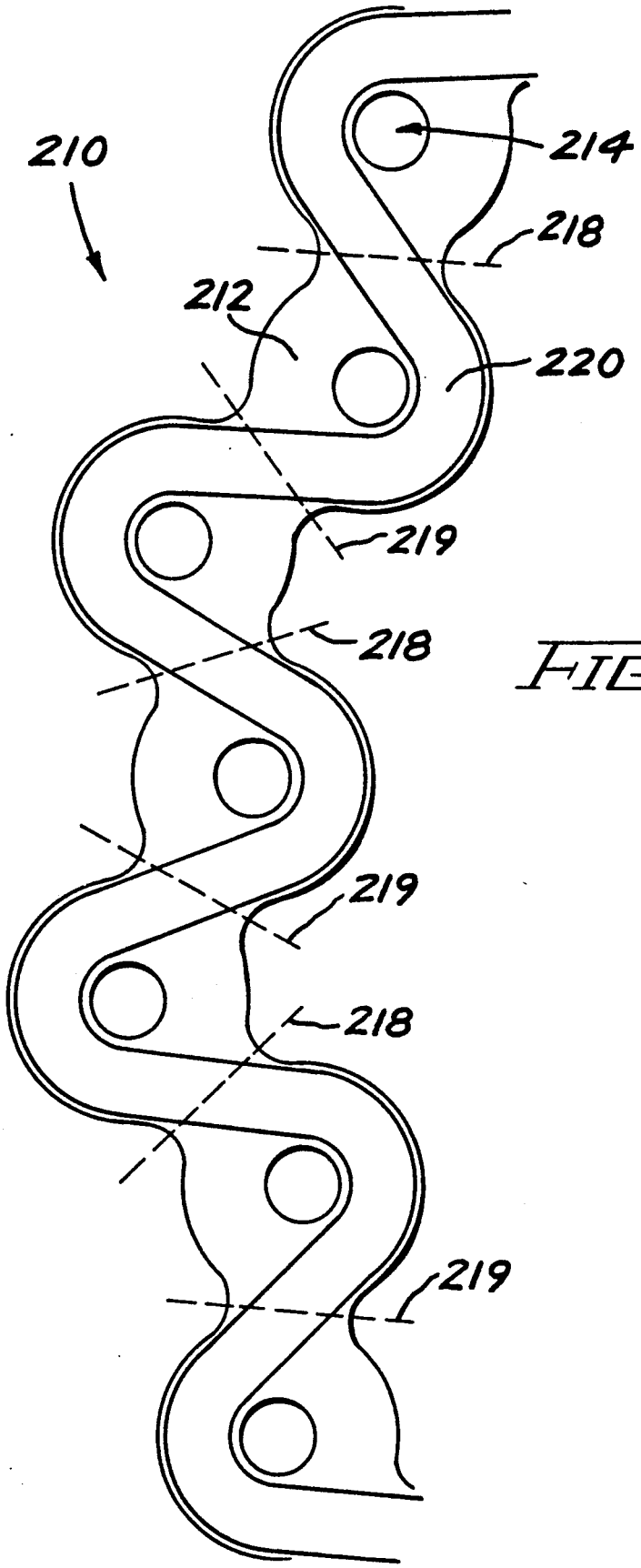
FIG. 14 is a plan view illustration of a multi-turn winding having a fraction of a turn per layer after folding in which that fraction is not a multiple of a quarter turn.

FIG. 14 is a plan view illustration of an alternative configuration for the conductive film of a multi-turn foldable winding. This winding 210 differs from the windings 10 and 110 in that the fold lines 218 and 219 are neither parallel nor perpendicular to each other and the winding does not form a whole multiple of a quarter turn per layer. The winding 210 may be converted into both windings of a 1:1 turns ratio transformer by providing a lengthwise-extending gap down the center of the serpentine pattern of the film 220 (similar to that in FIG. 3) to divide it into lefthand and righthand halves which then comprise separate windings, but are held in position by the dielectric membrane 212. The central post of a cup core is preferably inserted in the apertures 214 after folding.

While the specific embodiments illustrated have been described as being accordion folded, that is with adjacent folds in opposite senses, these films may have successive folds in the same sense if allowance for layer thicknesses is made in the film patterns. Mixtures of fold patterns may also be used. However, accordion folds are preferred. While a number of variations of conductive film windings in accordance with the present invention have been illustrated and described herein, those skilled in the art will be able to design many variations on the particular conductive film patterns employed in these embodiments without departing from the true spirit and scope of the present invention. For example, if it were desired to do so, the transformer of FIGS. 1, 2 and 4–8 could be formed by providing the primary winding on the lower surface only of membrane 12 as the conductive film 30 and by providing the secondary windings as conductive films 50 disposed on the upper surface of the same membrane 12 and by folding the membrane in a manner to bring the terminal portions 52, 54 and 56 of the secondary windings to the outside of the stack in an exposed manner for attachment of the external terminal strips. Many other pattern variations are possible while still providing layer-to-layer connections via the conductive film itself. Further, film patterns with more than one aperture in a layer and more than one post in a cup core may be used if desired. Substantially any desired turns ratio may be provided by appropriate design of the conductive film shapes and the manner of their interleaving after folding. Similarly, the relative number of layers in the windings of a transformer is a matter of design choice. From about 1/6 to about 5/6 of a winding turn per layer may conveniently be provided in accordance with this invention where a single film is employed in each layer. Further, although the tapped windings illustrated are center-tapped windings, it will be recognized that tapped windings in which the tap is not centered may also be used.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

What is claimed is:

1. In a magnetic component, the improvement wherein a winding comprises:

a first conductive film having first and second major surfaces, said film having a generally serpentine configuration when said first major surface is disposed in a plane;

said film being folded upon itself to form a stack of layers having an axis extending at an angle to the plane of said layers;

said serpentine configuration and the pattern of folding of said film combining to configure said film as a winding which encircles said axis in a manner to provide a plurality of turns;

dielectric material disposed between adjacent layers of said stack, said dielectric material including a dielectric membrane having first and second major surfaces, with said first major surface of said conductive film disposed in contact with said first major surface of said membrane; and said magnetic component including a second conductive film spaced from said first conductive film, disposed on said first major surface of said dielectric membrane and electrically insulated from the first conductive film, said second conductive film having a generally serpentine configuration which in said folded configuration, creates a second winding of said magnetic component encircling said axis.

2. The magnetic component recited in claim 1 wherein:

said second conductive film extends substantially parallel to said first conductive film.

3. The magnetic component recited in claim 1 wherein:

said first and second conductive films are of substantially the same length whereby said first and second windings have substantially equal numbers of turns.

4. The magnetic component recited in claim 1 wherein:

said second conductive film is substantially shorter than the first recited conductive film whereby said second winding has fewer turns than the first recited winding.

5. In a magnetic component, the improvement wherein a winding comprises:

a conductive film having first and second major surfaces, said film having a generally serpentine configuration when said first major surface is disposed in a plane;

said film being folded upon itself to form a stack of layers having an axis extending at an angle to the plane of said layers;

said serpentine configuration and the pattern of folding of said film combining to configure said film as a winding which encircles said axis in a manner to provide a plurality of turns;

dielectric material disposed between adjacent layers of said stack, said dielectric material including a dielectric membrane having first and second major surfaces, with said first major surface of said conductive film disposed in contact with said first major surface of said membrane, and said magnetic component including a second winding comprising:

a plurality of separate, second conductive films each disposed on a second dielectric membrane, and said second conductive films being interleaved with said layers of the first recited winding in said stack.

6. The magnetic component recited in claim 5 wherein:

said second membrane and said second conductive films are interleaved with said layers of the first recited winding in said stack in a manner in which said second membrane insulates the exposed surfaces of the conductive films of the first recited winding from each other and from said second conductive films.

7. The magnetic component recited in claim 5 wherein:

said second conductive films are connected in parallel.

8. The magnetic component recited in claim 7 wherein:

said second winding comprises a tapped winding having a tap terminal and first and second end terminals.

9. The magnetic component recited in claim 8 wherein:

each of said second conductive films has (1) a generally FIG. 8 configuration when disposed in a plane, (2) an insulating gap extending from each inner circle of said FIG. 8 to the outer boundary of said FIG. 8 in the vicinity of the joint between the upper and lower portions of said FIG. 8, said insulating gaps configured to provide a single conductive path extending from a first end at a first side of said FIG. 8 near the horizontal mid-line thereof, around one of said inner circles, back across said midline, around the other of said circles and back to a second end in the vicinity of said midline at a second side of said FIG. 8.

10. The magnetic component recited in claim 9 wherein:

at each end said film extends beyond said mid-line.

11. The magnetic component recited in claim 10 wherein:

said membrane is folded in the vicinity of said midline of each FIG. 8 in a manner to expose both ends and the middle of said conductive path on the outside of said fold.

12. The magnetic component recited in claim 10 wherein:

said first end terminal is attached to said first end of each second conductive film at said fold in said film;

said second end terminal is attached to said second end of each second conductive film at said fold in said film; and said tap terminal is connected to each second conductive film, intermediate said ends of said film, at said fold in said film.

13. The magnetic component recited in claim 12 further comprising a magnetic core including:

top and bottom magnetic walls disposed respectively adjacent upper and lower surfaces of said stack of layers;

a central magnetic member extending between said top and said bottom walls and through an aperture in said stack; and a peripheral magnetic wall extending between said top and bottom walls; and at least one of said walls includes an aperture for the passage of connections between said windings and external terminals.

14. The magnetic component recited in claim 8 wherein:

each of said second conductive films extends from said tap terminal to one of said first or second end terminals.

15. The magnetic component recited in claim 14 wherein:

each of said second films has a common, non-symmetric pattern and those of said second films which connect to said first end terminal are stacked in one orientation and those of said second films which connect to said second end terminal are stacked in a reversed orientation.

16. The magnetic component recited in claim 5 wherein:

said second membrane and said second conductive films are interleaved with said layers of the first recited winding in said stack in a manner in which said second membrane insulates the layers of the first recited film from each other and said second conductive films.

17. In a magnetic component, the improvement wherein a winding comprises:

a conductive film having first and second major surfaces, said film having a generally serpentine configuration when said first major surface is disposed in a plane;

said film being folded upon itself to form a stack of layers having an axis extending at an angle to the plane of said layers;

said serpentine configuration and the pattern of folding of said film combining to configure said film as a winding which encircles said axis in a manner to provide a plurality of turns;

dielectric material disposed between adjacent layers of said stack, said dielectric material comprising a membrane and said magnetic component further including:

a second winding comprising a plurality of separate, second conductive films each disposed on said dielectric membrane; and said dielectric membrane and said second conductive films being interleaved with said layers of the first recited winding in said stack in a manner in which said second winding encircles said axis and said membrane insulates the layers of the first recited conductive film from each other and from said second conductive films.

18. In a magnetic component, the improvement wherein a winding comprises:

a conductive film having first and second major surfaces, said film having a generally serpentine configuration when said first major surface is disposed in a plane;

said film being folded upon itself to form a stack of layers having an axis extending at an angle to the plane of said layers;

said serpentine configuration and the pattern of folding of said film combining to configure said film as a winding which encircles said axis in a manner to provide a plurality of turns;

dielectric material disposed between adjacent layers of said stack, and a second winding comprising a plurality of separate, second conductive films interleaved with layers of the first recited winding in said stack.

19. The magnetic component recited in claim 18 wherein:

said second conductive films are connected in parallel.

20. The magnetic component recited in claim 18 wherein:

said second winding comprises a tapped winding having a tap terminal and first and second end terminals.

21. The magnetic component recited in claim 20 further comprising a magnetic core including:

top and bottom magnetic walls disposed respectively adjacent upper and lower surfaces of said stack of layers;

a central magnetic member extending between said top and bottom walls and through an aperture in said stack; and a peripheral magnetic wall extending between said top and bottom walls.

22. The magnetic component recited in claim 21 wherein at least one of said walls includes an aperture for the passage of connections between said windings and external terminals.

23. In a magnetic component, a tapped winding comprising:

a plurality of conductive films, each disposed on a dielectric membrane;

each of said conductive films having (1) a generally FIG. 8 configuration when disposed in a plane, (2) an insulating gap extending from each inner circle of said FIG. 8 to the outer boundary of said FIG. 8 in the vicinity of the joint between the upper and lower portions of said FIG. 8, said insulating gaps configured to provide a single conductive path extending from a first end at a first side of said FIG. 8 near the horizontal mid-line thereof, around one of said inner circles, back across said midline, around the other of said circles and back to a second end in the vicinity of said midline at a second side of said FIG. 8, each of said films being folded in the vicinity of said mid-line with the inner circles of said FIG. 8's disposed substantially concentric with an axis; and said magnetic component including a tap terminal and first and second end terminals, with said tap terminal connected to each of said films in the vicinity of the mid-line and said first and second end terminals connected to each of said films in the vicinity of said first and second ends, respectively.

24. The magnetic component recited in claim 23 wherein:

at each end of each of said films extends beyond said mid-line onto said fold.

25. The magnetic component recited in claim 24 wherein:

said membrane is folded in a manner to expose both ends and the middle of said conductive path on the outside of said fold.

26. The magnetic component recited in claim 25 wherein:

said first end terminal is attached to said first end of each conductive film at said fold in said film;

said second end terminal is attached to said second end of each conductive film at said fold in said film; and said tap terminal is connected to each conductive films, intermediate said ends of said film at said fold in said film.

27. The magnetic component recited in claim 26 further comprising a magnetic core including:

top and bottom magnetic walls disposed respectively adjacent upper and lower surfaces of said stack of layers;

a central magnetic member extending between said top and said bottom walls and through an aperture in said stack; and

28. A magnetic component having a tapped winding comprising:

a tap terminal and first and second end terminals;

a first plurality of conductive films each of which extends from said tap terminal to said first end terminal; and a second plurality of conductive films each of which extends from said tap terminal to said second end terminal.

29. The magnetic component recited in claim 28 wherein:

each of said films has a common, non-symmetric pattern and those of said films which connect to said first end terminals are stacked in one orientation and those of said films which connect to said second end terminal are stacked in a reversed orientation.

30. The magnetic component recited in claim 29 wherein:

each of said terminals comprises a bar which is soldered to each of said films which extends to its associated terminal.

* * * * *